US008475995B2

(12) United States Patent
Hwang et al.

(10) Patent No.: US 8,475,995 B2
(45) Date of Patent: Jul. 2, 2013

(54) TONER HAVING CORE-SHELL STRUCTURE AND METHOD OF PREPARING THE SAME

(75) Inventors: Dae Il Hwang, Daejeon (KR); Woo Young Yang, Daejeon (KR); Keon Il Kim, Daejeon (KR); Il Hyuk Kim, Daejeon (KR); Jae Bum Park, Daejeon (KR); Il Sun Hwang, Daejeon (KR); Jae Kwang Hwang, Daejeon (KR); Dae Woong Choi, Daejeon (KR); Dong Won Kim, Daejeon (KR); Duck Kyun Ahn, Daejeon (KR)

(73) Assignee: Samsung Fine Chemicals Co., Ltd., Ulsan (KR)

( * ) Notice: Subject to any disclaimer, the term of this patent is extended or adjusted under 35 U.S.C. 154(b) by 343 days.

(21) Appl. No.: 12/739,706

(22) PCT Filed: Oct. 22, 2008

(86) PCT No.: PCT/KR2008/006256

§ 371 (c)(1),
(2), (4) Date: Apr. 23, 2010

(87) PCT Pub. No.: WO2009/054679

PCT Pub. Date: Apr. 30, 2009

(65) Prior Publication Data

US 2010/0232837 A1 Sep. 16, 2010

(30) Foreign Application Priority Data

Oct. 24, 2007 (KR) ..... 10-2007-0107416

(51) Int. Cl.
*G03G 9/093* (2006.01)

(52) U.S. Cl.
USPC ..... 430/137.17; 430/109.4; 399/222

(58) Field of Classification Search
USPC ..... 430/109.4, 137.17; 399/222
See application file for complete search history.

(56) References Cited

U.S. PATENT DOCUMENTS

| | | | | |
|---|---|---|---|---|
| 5,916,725 | A | 6/1999 | Patel et al. | |
| 6,177,223 | B1 | 1/2001 | Hashimoto et al. | |
| 6,268,103 | B1 | 7/2001 | Hopper et al. | |
| 2005/0208411 | A1 * | 9/2005 | Nakayama et al. | 430/109.4 |
| 2006/0204883 | A1 | 9/2006 | Nakayama et al. | |

FOREIGN PATENT DOCUMENTS

| | | | |
|---|---|---|---|
| JP | 3640918 | B2 | 4/2005 |
| JP | 3878537 | B2 | 2/2007 |
| JP | 3895172 | B2 | 3/2007 |
| KR | 1020050098662 | A | 10/2005 |
| KR | 1020060042017 | A | 5/2006 |
| KR | 1020060043747 | A | 5/2006 |

OTHER PUBLICATIONS

International Search Report, PCT/KR2008/006256, dated Jun. 2, 2009.

* cited by examiner

*Primary Examiner* — Peter Vajda
(74) *Attorney, Agent, or Firm* — Nixon Peabody LLP

(57) ABSTRACT

A toner has a core-shell structure including a toner core portion having a resin with an active hydrogenactive hydrogen containing group, a colorant and at least one additive, and a toner shell portion surrounding the toner core portion, wherein the toner shell portion includes a cross-linked resin prepared by reaction of at least a portion of the active hydrogen containing group and the cross-linking agent.

8 Claims, No Drawings

TONER HAVING CORE-SHELL STRUCTURE AND METHOD OF PREPARING THE SAME

CROSS-REFERENCE TO RELATED PATENT APPLICATION

This application is a national phase International Application No. PCT/KR2008/006256, entitled, "Toner Having Core-Shell Structure And Method Of Preparing The Same", which was filed on Oct. 22, 2008, and which claims priority of Korean Patent Application No. 10-2007-0107416, filed Oct. 24, 2007, in the Korean Intellectual Property Office, the contents of which are incorporated herein by reference.

TECHNICAL FIELD

An illustrative embodiment of the present invention relates to a toner and a method of preparing the same, and more particularly, to a toner in which excellent fixability at low temperature and excellent storage stability at high temperature are ensured and a method of preparing the toner.

BACKGROUND ART

Recently, the need for a toner capable of ensuring fixability at low temperature and storage stability at high temperature has increased in the printing industry.

Generally, a toner is prepared by adding a colorant, a charge control agent, a releasing agent, or the like to a thermoplastic resin acting as a binder resin. In addition, inorganic fine metal particles such as silica or a titanium oxide may be added to a toner as external additives in order to provide a toner with fluidity or improve its physical properties such as charge controlling properties or cleaning properties.

The methods of preparing such a toner can be categorized into physical and chemical methods.

The physical methods include a pulverization method. The pulverization method is a method of preparing a toner by obtaining a toner composition by melt-mixing a colorant, a charge control agent, and the like, with a binder resin, such as a polyester resin, dispersing the melt-mixture homogenously, and then pulverizing and classifying the toner composition. However, the pulverization method requires a pulverizer and related equipment for pulverizing the toner composition and thus high manufacturing costs are incurred in order to prepare small particulate toner particles. It is easy to generate toner particles having a wide particle size distribution during the pulverizing of the toner composition. In addition, there is a need to classify and remove fine toner particles having a particle size equal to or less than 3 μm and large toner particles having a particle size equal to or greater than 20 μm in order to obtain an image having high resolution and high gradation. Also, when an additive is not uniformly dispersed, the fluidity, developing properties, durability, and image quality of the toner may be adversely affected.

The chemical methods include a suspension-polymerization method and an emulsion-aggregation method.

The suspension-polymerization method is a method of preparing a toner by suspension-polymerizing toner materials in a solvent. The patent rights for such kinds of technologies are generally owned by firms such as Canon or the like. (U.S. Pat. No. 6,177,223). Problems of the above-mentioned pulverization method can be overcome by the suspension-polymerization method. However, in the suspension-polymerization method, since only styrene-acrylic copolymers can be used as a basic resin and toner particles prepared thereby are spherical in shape, cleaning properties may be poor. Thus, a toner may remain on a photosensitive medium, and thus quality of images formed thereby may deteriorate. As such, contamination will occur on a charging roller, etc. and charging properties may be adversely affected.

The emulsion-aggregation method is an example of a chemical method of preparing a toner composition (U.S. Pat. Nos. 5,916,725 and 6,268,103). The emulsion-aggregation method involves preparing a micro-emulsion resin particle composition through an emulsion polymerization reaction and then aggregating the composition with other toner components, e.g., a pigment dispersion and a releasing agent dispersion. In the emulsion-aggregation method, the above problems of the pulverization method can be overcome, and toner particles may have non-spherical shapes by adjusting aggregating conditions. However, only styrene-acrylic copolymers can be used as a binder resin, and preparation of a separate dispersion needs to be further included.

In such chemical methods, only styrene-acrylic copolymers can be used as a binder resin. Thus, polyester resins, which have excellent fluidity, and improved pigment dispersibility and transparency due to their own chemical structures, generally cannot be used in toners for a color printer and a high-speed printer.

An example of a method of preparing a toner using a polyester resin is a method using a self water dispersible polyester resin (U.S. Pat. No. 5,916,725). However, a sodium sulfonate group needs to be included in a resin for self dispersion in water. In addition, a toner including many such functional groups included in the resins may have poor stability since the toner is likely to be affected by external environmental factors such as moisture, etc. which are encountered after manufacture.

JP Patent Nos. 3,640,918, 3,895,172 and 3,878,537 disclose a dry toner including a toner binder (i.e., a binder resin) and a colorant. In this case, only a modified polyester resin is used as the toner binder, and preferably, the modified polyester resin together with an unmodified polyester resin is used as the toner binder. An example of the modified polyester resin may include a polyester prepolymer including an isocyanate group, or the like. Examples of the modified polyester resin may include a polycondensate of polyol and poly carboxylic acid, or the like. However, such preparation methods are complicated in that the prepolymer is prepared by way of an additional reaction in which an isocyanate is included in oligomer and the prepolymer is reacted with a cross-linking agent and/or an elongation agent so as to prepare a toner particle.

DISCLOSURE OF THE INVENTION

An illustrative embodiment of the present invention provides a toner in which excellent fixability at low temperature and excellent storage stability at high temperature are ensured and a method of preparing the toner.

Another illustrative embodiment of the present invention also provides an electrophotographic image forming device using the toner.

According to an aspect of the present invention, there is provided a toner including a toner core portion including a resin having an active hydrogen containing group, a colorant and at least one additive; and a toner shell portion surrounding the toner core portion, wherein the toner shell portion comprises a cross-linked resin prepared by reaction of at least a portion of the active hydrogen containing group and a cross-linking agent.

According to another aspect of the present invention, there is provided a method of preparing a toner, the method including forming an emulsion in which a organic solvent is dispersed in a dispersion medium in the form of a plurality of islands by adding the dispersion medium and the organic solvent to a reactor and mixing the resultant; forming a toner micro-suspension by adding a mixture including a resin having an active hydrogen containing group, a colorant and at least one additive to the reactor and then mixing the resultant; forming a toner core portion by removing the organic solvent from the toner micro-suspension; and forming a toner shell portion surrounding the toner core portion by crosslinking reaction of at least a portion of the active hydrogen containing group and a cross-linking agent.

According to another aspect of the present invention, there is provided an electrophotographic image forming device using the above toner.

BEST MODE FOR CARRYING OUT THE INVENTION

Hereinafter, the present invention will be described in more detail with reference to exemplary embodiments of the invention.

A toner according to an embodiment of the present invention includes a toner core portion and a toner shell portion surrounding the toner core portion.

The toner core portion includes a resin with an active hydrogen containing group, a colorant and at least one additive, and the toner shell portion is a cross-linked resin prepared by reaction of at least a portion of the active hydrogen containing group and a cross-linking agent.

First, the resin with an active hydrogen containing group will be described.

The active hydrogen containing group include at least one selected from the group consisting of a hydroxyl group (OH), a mercapto group (SH), a carboxyl group, a phosphate group, a sulfonate acid group and a sulfate group, which are easily bound to a cross-linking agent such as an isocyanate compound or an epoxy compound, which will be described later. A resin with hydroxyl groups and/or carboxyl groups is advantageously conveniently used to react with the cross-linking agent. The resin may be, for example, a polyester resin with an active hydrogen containing group. The polyester resin is suitable in view of dispersibility of a colorant and low temperature fixability. The content of the active hydrogen containing group included in the resin may be in the range of 0.1 to 2 mmol KOH/g, which is equivalent to the sum of the contents of acid groups and hydroxyl groups of the resin. When the content of the active hydrogen containing group is less than 0.1 mmol KOH/g, preparation of a toner, which will be described, is not easy and charging properties of the toner may be poor. When the content of the active hydrogen containing group is higher than 2 mmol KOH/g, the environmental stability of the prepared toner may be significantly reduced. Preferably, the content of the active hydrogen containing group may be in the range of 0.15 to 1.2 mmol KOH/g.

Here, the polyester resin may be prepared by polycondensation in which polyhydric alcohol components and polybasic carboxylic acid components are mixed and heated, optionally, under reduced pressure or in the presence of a catalyst. Examples of the polyhydric alcohol components are polyoxyethylene-(2.0)-2,2-bis(4-hydroxyphenyl)propane, polyoxypropylene-(2.0)-2,2-bis(4-hydroxyphenyl)propane, polyoxypropylene-(2.2)-polyoxyethylene-(2.0)-2,2-bis(4-hydroxyphenyl)propane, polyoxyethylene-(2.3)-2,2-bis(4-hydroxyphenyl)propane, polyoxypropylene-(6)-2,2-bis(4-hydroxyphenyl)propane, polyoxypropylene-(2.3)-2,2-bis(4-hydroxyphenyl)propane, polyoxypropylene-(2.4)-2,2-bis(4-hydroxyphenyl)propane, polyoxypropylene-(3.3)-2,2-bis(4-hydroxyphenyl)propane, polyoxyethylene-(6)-2,2-bis(4-hydroxyphenyl)propane, ethylene glycol, 1,3-propylene glycol, 1,2-propylene glycol, 1,4-butylene glycol, 1,3-butylene glycol, and glycerol polyoxypropylene. Examples of the polybasic carboxylic acid components are an aromatic polybasic acid and/or an alkyl ester thereof that are commonly used in the preparation of the polyester resin. Examples of the aromatic polybasic acid are terephthalic acid, isophthalic acid, trimellitic acid, pyromellitic acid, 1,2,4-cyclohexane tricarboxylic acid, 2,5,7-naphthalene tricarboxylic acid, 1,2,4-naphthalene tricarboxylic acid, 1,2,5-hexane tricarboxylic acid, 1,2,7,8-octane tetracarboxylic acid, and/or alkyl esters of these carboxylic acids, wherein the alkyl group may be a methyl group, an ethyl group, a propyl group or a butyl group. The polybasic acid and/or alkyl esters thereof may be used alone or in a combination of two or more of them.

The content of the resin with the active hydrogen containing group may be in the range of 50 to 98 parts by weight based on 100 parts by weight of the total toner composition. When the content is less than 50 parts by weight, the amount of the resin is insufficient for binding the toner composition. When the content is higher than 98 parts by weight, the content of the toner composition excluding the resin is too little to preserve the function of the toner. Here, the toner composition includes a colorant, an additive, a cross-linked resin and an external additive, which will be described later, in addition to the resin with the active hydrogen containing group.

The number average molecular weight of the resin with the active hydrogen containing group is in the range of 600 to 4,000. When the number average molecular weight is less than 600, the melt viscosity is too low and the fixing temperature range is too narrow. When the number average molecular weight is greater than 4,000, reactivity with a cross-linking agent is reduced. In this case, even if a crosslinking reaction is performed, since the content of high molecular weight materials are high, the low temperature fixability and the gloss of the resin may be poor.

The colorant may be used in the form of a pigment itself, or alternatively, in the form of a pigment master batch in which the pigment is dispersed in a resin. By using the pigment master batch, the charging properties of the toner particles can be improved by suppressing the surface exposure of the colorant.

A resin used in the pigment master batch may be the resin with the active hydrogen containing group or another known resin. The pigment master batch is a resin composition in which a pigment is uniformly dispersed. The pigment master batch is prepared by blending a pigment and a resin at high temperature and high pressure, or by dissolving a resin in a solvent to make a solution, adding a pigment to the solution and applying a high shearing force to disperse the pigment. In the pigment master batch used in an embodiment of the present invention, the amount of the pigment may be in the range of 10 to 70 parts by weight, preferably 20 to 50 parts by weight based on 100 parts by weight of the pigment master batch. When the amount of the pigment is less than 10 parts by weight, a desired color may not be reproduced because the content of the pigment in the toner is too low. On the other hand, when the pigment is greater than 70 parts by weight, the pigment dispersion may not be uniform within the pigment master batch.

The pigment may be selected appropriately from pigments commonly and commercially used, such as a black pigment, a cyan pigment, a magenta pigment, a yellow pigment and a mixture thereof.

Examples of the pigments are as follows. That is, a titanium oxide or carbon black may be used as the black pigment. A copper phthalocyanine compound and derivatives thereof, an anthraquine compound or a base dye lake compound can be used as the cyan pigment. In particular, a C.I. pigment blue 1, 7, 15, 15:1, 15:2, 15:3, 15:4, 60, 62, 66, or the like can be used. A condensed nitrogen compound, an anthraquine, a quinacridone compound, a base dye lake compound, a naphthol compound, a benzo imidazole compound, a thioindigo compound, or a perylene compound can be used as the magenta pigment. Particularly, C.I. pigment red 2, 3, 5, 6, 7, 23, 48:2, 48:3, 48:4, 57:1, 81:1, 144, 146, 166, 169, 177, 184, 185, 202, 206, 220, 221, 254, or the like can be used. A condensed nitrogen compound, an isoindolinone compound, an anthraquine compound, an azo metal complex, or an allyl imide compound can be used as the yellow pigment. Particularly, C.I. pigment yellow 12, 13, 14, 17, 62, 74, 83, 93, 94, 95, 109, 110, 111, 128, 129, 147, 168, or the like can be used.

The amount of the colorant may be an amount sufficient to color the toner and form a visible image by development, and preferably may be in an amount in the range of 3 to 15 parts by weight based on 100 parts by weight of the resin. When the amount of the colorant is less than 3 parts by weight, a coloring effect is not sufficient. On the other hand, when the amount of the colorant is greater than 15 parts by weight, a sufficient frictional charge amount cannot be obtained due to low electrical resistance, thereby causing contamination.

Additionally, the additive may include a charge control agent, a releasing agent or a mixture thereof.

The charge control agent may be a negative charge control agent and a positive charge control agent. Examples of the negative charge control agent are an organic metal complex or a chelate compound such as an azo complex containing chromium or a mono azo metal complex; a salicylic acid compound containing metal such as chromium, iron and zinc; and an organic metal complex of an aromatic hydroxycarboxylic acid and an aromatic dicarboxylic acid, and any known negative charge control agent may be used without limitation. Examples of the positive charge control agent are nigrosine and products of nigrosine modified with a fatty acid metal salt; and an onium salt including a quaternary ammonium salt such as tributylbenzylammonium 1-hydroxy-4-naphthosulfonate and tetrabutylammonium tetrafluoroborate. These positive charge control agents may be used alone or in combination of two or more. Since the charge control agent stably and quickly charges a toner by its electrostatic force, the toner can be stably supported on a developing roller.

The amount of the charge control agent included in the toner may generally be in the range of 0.1 to 10 parts by weight based on 100 parts by weight of the toner composition. When the amount of the charge control agent is less than 0.1 parts by weight, toner charging speed is too low and the charging amount is too low to function as a charge control agent. On the other hand, when the amount of the charge control agent is greater than 10 parts by weight, overcharging may occur and this may distort a formed image.

The releasing agent may enhance the fixability of a toner image, and examples of the releasing agent are a polyalkylene wax such as low molecular weight polypropylene wax and low molecular weight polyethylene wax, ester wax, carnauba wax and paraffin wax. The amount of the releasing agent included in the toner may be in the range of 0.1 to 30 parts by weight based on 100 parts by weight of the toner composition. When the amount of the releasing agent is less than 0.1 parts by weight, oil-less fixing of toner particles in which toner particles are fixed without using oil cannot be achieved. On the other hand, when the amount of the releasing agent is greater than 30 parts by weight, toner may become flocculated during storage.

In addition, the additive may further include a higher fatty acid, fatty acid amide, metal salt thereof, or the like. The higher fatty acid, the fatty acid amid, the metal salt thereof, or the like may be appropriately used in order to prevent deterioration of developing properties and to obtain high quality images.

A toner core portion may be prepared by using the resin with the active hydrogen containing group, a colorant and at least one additive, according to a preparation method, which will be described later.

An isocyanate compound or an epoxy compound may be used as the cross-linking agent that is cross-linked with the active hydrogen of the resin included in the toner core unit, but an isocyanate compound may be preferably used.

Examples of the isocyanate compound may include a known aromatic, aliphatic and/or acyclic isocyanate compound, a tri-functional isocyanate compound, and isocyanate functional adducts of polyol and diisocyanate compounds. Generally useful examples of the isocyanate compound may include 1,6-hexamethylene diisocyanate, isophorone diisocyanate, 4,4-biphenylene diisocyanate, toluene diisocyanate, bis-cyclohexyl diisocyanate, tetramethylene xylene diisocyanate, ethyl ethylene diisocyanate, 2,3-dimethyl ethylene diisocyanate, 1-methyltrimethylene diisocyanate, 1,3-phenylene diisocyanate, 1,5-naphthalene diisocyanate, bis-(4-isocyanatocyclohexyl)-methane, 4,4-diisocyanatodipheny ether, triphenylmethane triisocyanate, 1,3,5-benzene triisocyanate, 2,4,6-toluene triisocyanate, triol and a tri-functional adduct of diisocyanate. In addition, the isocyanate is blocked with oxime, caprolactam or dimethylpyrazole, or the like may by used. Furthermore, a combination of two or more kinds of the isocyanate may be used. When block-copolymerized isocyanate is used, the block-copolymerized isocyanate may be heated to a dissociation temperature in order to dissociate the blocked group.

Example of the epoxy compound may include diphenylolpropane type epoxy resin, diphenylolmethane type epoxy resin, novolac type epoxy resin, diamine type epoxy resin, diacid type epoxy resin, diol type epoxy resin and the like, which have two through 5 epoxy functional groups.

The content of the cross-linking agent may be in the range of 0.004 to 0.15 mol based on 1 mol of the active hydrogen containing group that are generally used, and may preferably be 0.008 to 0.075 mol.

When the content of the cross-linking agent is less than 0.004 mol, cross-linking is not sufficient. Thus, storage stability at high temperature is not improved, resistance to hot offset deteriorates, and the fixing temperature range becomes too narrow. When the content of the cross-linking agent is greater than 0.15 mol, since the content of high molecular weight materials are increased due to the crosslinking reaction, the low temperature fixability of the resin deteriorates.

A cross-linked resin is formed by the crosslinking reaction of the active hydrogen of the resin and the cross-linking agent. The crosslinking reaction mainly occurs around an external surface of the toner core portion to form a toner shell portion. Thus, the toner shell portion is formed of the cross-linked resin. Accordingly, a toner composite having the toner core portion-shell portion is formed. In addition, the resin included in the toner core portion has a relatively low molecular weight and the cross-linked resin of the toner shell portion has a relatively high molecular weight, in consideration of a magnitude of molecular weight. As a result of such a structure, since a composite structure of the toner core portion-shell portion is maintained in a high temperature storage environment, flocculation between toner particles does not occur in the completed toner. In addition, since the toner shell portion is easily destructed in a low temperature fixation environment, the toner can be smoothly fixed. Accordingly, excellent storage stability at high temperature and excellent fixability at low temperature can be simultaneously ensured.

The toner composite may further include external additives. The external additive may be used to improve fluidity of toner or control charging properties, and examples of the external additive are large particulate silica, small particulate silica and polymer beads.

Hereinafter, a method of preparing a toner according to an embodiment of the present invention will be described.

First, a polar solvent, a surfactant, and a thickener (if required) are mixed, stirred, and heated to sufficiently dissolve solid components of the mixture, thereby preparing a dispersion medium.dispersion medium After it is determined that the solids have completely dissolved, an organic solvent is added to the dispersion medium dispersion medium. Thereby, a milky white emulsion in which the organic solvent is dispersed in the dispersion mediumdispersion medium in the form of a plurality of islands is obtained.

Then, a resin with an active hydrogen containing group, a colorant and at least one additive are added to the reactor, and mixed with the emulsion to form a toner micro-suspension. At this time, soluble solids are dissolved in the organic solvent that is dispersed in forms of a plurality of islands. Thus, according to the above method, a dissolution time of solids as well as the used amount of an organic solvent can be reduced compared to a conventional method in which soluble solids are dissolved by adding resins, etc. to an organic solvent in a bulk form. In addition, by changing the order of adding the resin, the colorant and the additive to the reactor containing the emulsion, the configuration of toner components of a complete toner particle can be controlled. For example, when a releasing agent and a resin are sequentially added to the reactor in the order stated above, since the resin surrounds the releasing agent, the releasing agent having viscosity at low temperature is not exposed to the outside of a toner particle. Thus, conventional problems can be overcome since the toner particle does not attach to various rollers (e.g., a feed roller, a transfer roller, etc.) of an image forming device and no toner remains and accumulates thereon. In addition, when the resin and the releasing agent are sequentially added to the reactor in the order stated above, since the releasing agent is exposed to a surface of the resin, a completed toner particle can have high gloss properties.

Then, while stirring and heating the toner micro-suspension, the organic solvent may be removed under a partially reduced pressure. A heating temperature may be in the range of 60 to 90° C. As a result, a toner core portion is obtained.

Then, a cross-linking agent is added to the reactor to be cross-linked to some of the active hydrogen containing group (i.e., active hydrogen), and thus a toner shell portion surrounding the toner core portion is formed. As a result, a toner composite of a structure of a toner core portion-toner shell portion is obtained.

Lastly, the toner composite is cooled, filtered using a filter, etc., washed and dried to obtain toner particles.

According to the above method of preparing the toner, the organic solvent is dispersed uniformly in the form of islands in the dispersion medium during the forming of the emulsion, and components of a toner are added to the islands of the organic solvent to constitute the toner composite. Thus, separate aggregation and melt-adhesion operations are not required, thereby simplifying manufacturing processes and reducing manufacturing costs. However, the present invention is not limited thereto. If necessary, aggregation and/or melt-adhesion operations may be further included.

The organic solvent used in the preparation is volatile, has a lower boiling point than polar solvents, and is not miscible with polar solvents, and may include at least one type selected from the group consisting of esters such as methyl acetate or ethyl acetate; ketones such as acetone or methylethyl ketone; hydrocarbons such as dichloromethane or trichloroethane; and aromatic hydrocarbons such as benzene.

The polar solvent may be at least one selected from the group consisting of water, glycerol, ethanol, ethylene glycol, propylene glycol, diethylene glycol, dipropylene glycol, and sorbitol, and may preferably be water.

The thickener may be at least one selected from the group consisting of polyvinyl pyrrolidone, polyvinyl alcohol, polyacrylic acid, gelatin, chitosan and sodium alginate, and may preferably be polyvinyl alcohol.

The surfactant may include at least one selected from the group consisting of a nonionic surfactant, an anionic surfactant, a cationic surfactant and an amphoteric surfactant.

Examples of the nonionic surfactant are polyvinyl alcohol, polyacrylic acid, methylcellulose, ethylcellulose, propylcellulose, hydroxyethylcellulose, carboxymethylcellulose, polyoxyethylene cetyl ether, polyoxyethylene lauryl ether, polyoxyethylene octylphenyl ether, polyoxyethylene norylphenyl ether, ethoxylate, phosphate norylphenols, triton, and dialkylphenoxypoly(ethyleneoxy)ethanol. Examples of the anionic surfactant are sodium dodecyl sulfate, sodium dodecyl benezene sulfonate, sodium dodecyl naphthalene sulfate, dialkyl benzenealkyl sulfate, and sulfonate. Examples of the cationic surfactant are alkyl benzene dimethyl ammonium chloride, alkyl trimethyl ammonium chloride, and distearyl ammonium chloride. Examples of the amphoteric surfactant are amino acid amphoteric surfactant, betaine amphoteric surfactant, lecitin, taurin, cocoamidopropylbetaine, and disodium cocoamphodiacetate. The surfactants described above may be used alone or in combination of two or more.

The toner prepared by a method according to an embodiment of the present invention may be applied to an electrophotographic image forming device. Here, the electrophotographic image forming device may be a laser printer, a photocopier or a facsimile.

The present invention will be described in further detail with reference to the following examples. These examples are for illustrative purposes only and are not intended to limit the scope of the present invention.

PREPARATION EXAMPLE

Synthesis of Polyester Resin Having an Active Hydrogen-Containing Group

Preparation Example 1

Synthesis of Polyester Resin 1

A 3 L reactor equipped with a stirrer, a thermometer, and a condenser was installed in an oil bath which is a heat transfer medium. Monomers, in detail 50 g of dimethyl terephthalate, 47 g of dimethyl isophthalate, 80 g of 1,2-propylene glycol, and 3 g of trimellitic acid were added to the reactor. Then, 0.09 g (i.e., an amount of 500 ppm with respect to the total weight of the monomers) of dibutyltin oxide wad added thereto as a catalyst. Then, the reactor was heated to 150° C. while stirring the mixture at a speed of 150 rpm. The reaction was performed for about 6 hours, and then the reactor was heated to 220° C. The reaction pressure was decreased to 0.1 torr in order to remove byproducts. Then the reaction was performed for 5 hours, thereby completing the preparation of a polyester resin 1.

The glass transition temperature (Tg) of the polyester resin 1 was measured to be 41° C. using a differential scanning calorimeter (DSC). Also, the number average molecular weight of the polyester resin 1 was determined to be 1,300 using a gel permeation chromatography (GPC) using polystyrene as a standard sample. The content of active hydrogen-containing group was measured to be 0.4 mmolKOH/g by titration.

Preparation Example 2

Preparation of Polyester Resin 2

Polyester resin 2 was prepared in the same manner as in Preparation Example 1, except that the process of removing byproducts was performed for 11 hours. The Tg of the polyester resin 2 was measured to be 45° C. using a DSC after the reaction. The number average molecular weight was measured to be 2,500 using a GPC using polystyrene as a standard sample. The amount of an active hydrogen-containing group was measured to be 0.2 mmolKOH/g by titration.

Preparation of Pigment Master Batch

Preparation Example 3

Preparation of Black Pigment Master Batch 1

The polyester resin 1 synthesized in Preparation Example 1 and carbon black pigment (NIPEX 150, manufactured by Degussa GmbH of Germany) were mixed in a weight ratio of 8:2. Then, 50 parts by weight of ethyl acetate based on 100 parts by weight of the polyester resin was added thereto and the mixture was heated to about 60° C., and then stirred with a kneader for 60 minutes. Then, while the mixture was stirred at a speed of 50 rpm using a biaxial extruder having a vacuum device, ethyl acetate as a solvent was removed using the vacuum device to obtain a black pigment master batch 1.

Preparation Example 4

Preparation of Cyan Pigment Master Batch

A cyan pigment master batch was prepared in the same manner as in Preparation Example 3, except that the polyester resin 1 prepared in Preparation Example 1 and cyan pigment (C.I. pigment blue 15:3, CI no. 74160, manufactured by DIC) were used.

Preparation Example 5

Preparation of Yellow Pigment Master Batch

A yellow pigment master batch was prepared in the same manner as in Preparation Example 3, except that the polyester resin 1 prepared in Preparation Example 1 and yellow pigment (Toner Yellow HG, manufactured by Clariant of Germany) were used.

Preparation Example 6

Preparation of Black Pigment Master Batch 2

A black pigment master batch 2 was prepared in the same manner as in Preparation Example 3, except that the polyester resin prepared in Preparation Example 2 was used.

Preparation of Toner Particles

Example 1

400 g of distilled water, 10 g of polyvinyl alcohol (P-24, manufactured by DC Chemical Co. of Seoul, South Korea), 5 g of sodium dodecylsulfate (manufactured by Aldrich Chemical Company in Milwaukee, Wis.), as an anionic surfactant, were added to a pressurizable 1 L reactor equipped with a condenser, a thermometer, and a impeller stirrer, and then solids were completely dissolved by heating and stirring the reactor at a rate of 500 rpm at 70° C. to obtain a dispersion medium. After it was determined that the solids had completely dissolved in the dispersion medium, methyl ethyl ketone (manufactured by Aldrich Chemical Company in Milwaukee, Wis.) was added to the dispersion medium and thereby a milky white emulsion was obtained.

Then, 60 g of the polyester resin 1 synthesized in Preparation Example 1, 40 g of the black pigment master batch prepared in Preparation Example 3, 2 g of a charge control agent (N-23, manufactured by HB Dinglong in Hubie, China) and 8 g of paraffin wax were sequentially added to the reactor in the order stated. The resultant were mixed at a stirring speed of 1000 rpm at 75° C. for 5 hours.

Then, the stirring speed was decreased to 300 rpm, and methyl ethyl ketone, as an organic solvent, was removed from the resulting mixture under a partially reduced pressure of 100 mmHg while the reactor was heated to 90° C. After 4 hours, the amount of obtained methyl ethyl ketone was measured to check that the methyl ethyl ketone had been completely removed, and then the reactor was cooled down to 60° C.

Then, after 0.84 g of an isocyanate (BI 7986, manufactured by Baxenden Chemical, United Kingdom) as a cross-linking agent, which corresponds to 0.01 mol with respect to 1 mol of active hydrogen containing group of the resin, was added to the reactor, and the condenser was removed, and then the reactor was made airtight. Then, the content of the reactor was stirred at a stirring speed of 300 rpm and a temperature of 60° C. for 1 hour. Then, the stirring speed was raised to 1000 rpm, the temperature was increased to 120° C., and the content of the reactor was stirred for 2 hours. As a result, a toner was obtained.

Then, the reactor was cooled to 25° C., and the toner was separated from the reactor by using a filter that is commonly used in the art. The toner was washed with 1 N hydrochloric acid solution, and then washed 5 times with distilled water to completely remove a surfactant, and the like. Then, the washed toner particles were dried in a fluidized bed dryer at 40° C. for 5 hours to obtain dried toner particles.

As a result of analyzing the toner particles, it was found that the obtained toner particles had a volume average particle size of 6.7 μm, a 80% span value of 0.55 and circularity of 0.982.

Example 2

Toner particles were prepared in the same manner as in Example 1 except that 0.17 g of an isocyante as a crosslinking agent, which corresponds to 0.002 mol with respect to 1 mol of active hydrogen containing group of the resin, was added to the reactor.

As a result of analyzing the toner particles, it was found that the obtained toner particles had a volume average particle size of 6.8 μm, a 80% span value of 0.59 and circularity of 0.984.

Example 3

Toner particles were prepared in the same manner as in Example 1 except that ethyl acetate, as an organic solvent, was used instead of methyl ethyl ketone.

As a result of analyzing the toner particles, it was found that the obtained toner particles had a volume average particle size of 7.1 μm, a 80% span value of 0.60 and circularity of 0.986.

Example 4

Toner particles were prepared in the same manner as in Example 1 except that 20 g of the cyan pigment master batch prepared in Preparation Example 4 instead of the black pigment master batch prepared in Preparation Example 3 and 80 g of the polyester resin 1 synthesized in Preparation Example 1 were used.

As a result of analyzing the toner particles, it was found that the obtained toner particles had a volume average particle size of 6.9 μm, a 80% span value of 0.64 and circularity of 0.984.

Example 5

Toner particles were prepared in the same manner as in Example 1 except that 20 g of the yellow pigment master batch prepared in Preparation Example 5 instead of the black pigment master batch prepared in Preparation Example 3 and 80 g of the polyester resin 1 synthesized in Preparation Example 1 were used.

As a result of analyzing the toner particles, it was found that the obtained toner particles had a volume average particle size of 6.4 μm, a 80% span value of 0.61 and circularity of 0.988.

Example 6

Toner particles were prepared in the same manner as in Example 1 except that the polyester resin 2 synthesized in Prepared Example 2 and the black pigment master batch 2 prepared in Preparation Example 6 were respectively used instead of the polyester resin 1 synthesized in Preparation Example 1 and the black pigment master batch 1 prepared in Preparation Example 3.

As a result of analyzing the toner particles, it was found that the obtained toner particles had a volume average particle size of 6.6 μm, a 80% span value of 0.59 and circularity of 0.978.

Example 7

Toner particles were prepared in the same manner as in Example 1 except that 16.8 g of an isocyanate (BI 7986, manufactured by Baxenden Chemical, United Kingdom) as a cross-linking agent, which corresponds to 0.2 mol with respect to 1 mol of active hydrogen containing group of the resin, was added to the reactor.

As a result of analyzing the toner particles, it was found that the obtained toner particles had a volume average particle size of 6.4 μm, a 80% span value of 0.57 and circularity of 0.991.

Comparative Example 1

A toner was prepared in the same manner as in Example 1 except that the addition of the cross-linking agent to the reactor and the crosslinking reaction were not performed.

As a result of analyzing the toner particles, it was found that the obtained toner particles had a volume average particle size of 6.8 μm, a 80% span value of 0.59 and circularity of 0.989.

Volume average particles sizes of the toner according to Examples 1 through 7 and Comparative Example 1 were measured using a Coulter Multisizer 3. An aperture of 100 μm was used in the Coulter Multisizer, an appropriate amount of a surfactant was added to 50 to 100 ml of ISOTON-II (Beckman Coulter Co.) as an electrolyte, and 10 to 15 mg of a sample to be measured was added thereto, and the resultant was dispersed in a ultrasonic dispersing apparatus for 1 minute to prepare a sample for the Coulter Multisizer.

In addition, the 80% span value which is a value that indicates the particle size distribution was calculated by Equation 1 below. The volume of toner particles is accumulated from particles of the smallest size in ascending order until the accumulated volume reaches 10% of the total volume of the toner. An average particle size of the accumulated particles corresponding to 10% of the total volume of the toner is defined as d10. Average particle sizes of the accumulated particles corresponding to 50% and 90% of the total volume of the toner are respectively defined as d50 and d90.

$$80\% \text{ span value} = (d90 - d10)/d50 \qquad \text{Equation 1}$$

Here, a smaller span value indicates a narrower particle size distribution, and a larger span value indicates a wider particle size distribution.

Circularity was measured by using an FPIA-3000 (manufactured by Sysmex in Japan). While measuring the circularity by using the FPIA-3000, sample was manufactured by adding a suitable amount of surfactant to 50~100 ml of distilled water, adding 10~20 mg of toner particles thereto, and then dispersing the resultant in an ultrasonic disperser for 1 min.

The circularity is automatically obtained by the FPIA-3000 according to Equation 2 below.

$$\text{Circularity} = 2 \times (\text{area} \times \pi)^{1/2}/\text{perimeter} \qquad \text{Equation 2}$$

Here, the area indicates a projected area of the toner and the perimeter indicates a projected circumference of the toner. A value of the circularity may be in the range of 0 to 1, the closer the value is to 1, the more circular the toner is.

Meanwhile, a method of evaluating resins is as follows.

Using a differential scanning calorimeter (Model STA 409 manufactured by Netzsch Co.), a sample was heated from 20 to 200° C. at 10° C./min, rapidly cooled to 10° C. at 20° C./min, and heated at 10° C./min to measure a glass transition temperature (Tg).

The content of the active hydrogen containing group was calculated by adding the contents of acid groups to hydroxyl groups as follows.

First, the content (mmol KOH/g) of acid groups was measured as follows. 0.5 to 2 g of a resin was dissolved in 100 ml of dichloromethane and cooled, and then the mixture was titrated with a 0.1 KOH methyl alcohol solution by using a potential difference titrating apparatus (Metrohm 736 GP Titrino, manufactured by Metrohm). Then, the content (mmol KOH/g) of acid groups was calculated according to Equation 3 by measuring the used amount S (ml) of 0.1 N KOH methyl alcohol solution, which was used to titrate the mixture, and the weight W (g) of the resin used.

$$\text{Content of acid groups (mmol KOH/g)} = S/(W \times 10) \qquad \text{Equation 3}$$

Then, the content of hydroxyl groups (mmol KOH/g) was measured as follows. 1 to 2 g of anhydrous acetic acid and 3 to 4 g of pyridine were mixed with 0.5-2 g of a resin and the mixture was heated at a temperature in the range of 90 to 100°

C. for one hour, and then cooled. 1 to 2 ml of water was added to the mixture to dissolve anhydrous acetic acid that was not reacted. 100 ml of dichloromethane was added to the mixture. Then, the mixture was titrated with 0.1 N KOH of a methyl alcohol solution in the same manner as in the case of the measurement of acid groups. The used amount S' (ml) of 0.1 N KOH methyl alcohol solution, which was used to titrate the mixture, and the weight W' (g) of the resin used were measured. In addition, a blank test was performed without the resin, and then the used amount B (ml) of 0.1 N KOH methyl alcohol solution, which was used to titrate the mixture, was measured. Then, the content of hydroxyl groups was calculated according to Equation 4.

$$\text{Content of hydroxyl groups (mmol KOH/g)} = (B-S')/(W' \times 10) + \text{Content of acid groups} \quad \text{Equation 4}$$

Toner particles prepared according to Examples 1 through 7 and Comparative Example 1 were evaluated as follows.

Storage Stability at High Temperature 9.75 g of toner particles prepared in any of Examples 1 through 7 and Comparative Example 1, 0.2 g of silica (TG 810G, manufactured by Cabot), and 0.05 g of silica (RX50, manufactured by Degussa) were added to a 25 ml glass bottle, and the mixture was left for 72 hours under a temperature/moisture condition of 50° C./80%. Then, the storage stability at high temperature was evaluated by visually observing the resultant. The results of evaluation are shown below, with ○, Δ, and x symbols. The symbols have the following meanings.

○: No flocculation, thus no problem.

Δ: Weak flocculation, but flocculated toner particles were scattered when shaken; no problems occurred when used.

x: Strong flocculation, flocculated toner particles were not scattered; problems occurred when used.

Fixing Temperature Range 9.7 g of toner particles prepared in any of Examples 1 through 7 and Comparative Example 1, 0.2 g of silica (TG 810G; Cabot Co.) and 0.05 g of silica (RX50, Degussa GmbH) were mixed to prepare a toner with external additives. Using the toner with external additives, unfixed solid images of 30 mm×40 mm were prepared by a Samsung CLP-510 printer. Then, the fixing properties of the unfixed images were evaluated while varying the temperature of a fixing roller at a fixing tester in which the fixing temperature could be controlled.

The results of the evaluation are shown in Table 1 below.

TABLE 1

| Number of Example or Comparative Example | High Temperature Storage Stability | Fixing Temperature Range ( ) |
|---|---|---|
| Example 1 | ○ | 140~200 |
| Example 2 | ○ | 140~190 |
| Example 3 | ○ | 140~200 |
| Example 4 | ○ | 140~200 |
| Example 5 | ○ | 140~200 |
| Example 6 | ○ | 150~210 |
| Example 7 | ○ | 180~220 |
| Comparative Example 1 | X | 130~160 |

Referring to Table 1, high temperature storage stability of the toner prepared in Examples 1 through 7 was good. However, high temperature storage stability of the toner prepared in Comparative Example 1 was poor. In addition, both low and high temperature fixability of the toner prepared in Examples 1 through 6 was good. However, low temperature fixability of the toner prepared in Example 7 was worse than in the case of Examples 1 through 6, and high temperature fixability of the toner prepared in Example 7 was better than in the case of Examples 1 through 6. In addition, low temperature fixability of the toner prepared in Comparative Example 1 was better than in the case of Examples 1 through 6, and high temperature fixability of the toner prepared in Example 7 was worse than in the case of Examples 1 through 6. Thus, it can be seen that when the appropriate amount of a cross-linking agent is used, fixability at both low and high temperatures can be simultaneously ensured.

While the present invention has been particularly shown and described with reference to exemplary embodiments thereof, it will be understood by one of ordinary skill in the art that various changes in form and details may be made therein without departing from the spirit and scope of the present invention as defined by the following claims.

The invention claimed is:

1. A method of preparing a toner, the method comprising:

forming an emulsion in which an organic solvent is dispersed in a dispersion medium in the form of a plurality of islands by mixing the dispersion medium and the organic solvent in a reactor;

forming a toner micro-suspension by adding a mixture including a resin having an active hydrogenactive hydrogen containing group, a colorant and at least one additive to the reactor and then mixing the resultant;

forming a toner core portion by removing the organic solvent from the toner micro-suspension; and forming a toner shell portion surrounding the toner core portion by crosslinking reaction of at least a portion of the active hydrogen containing group and a cross-linking agent.

2. The method of claim 1, further comprising:

forming a toner particle by separating a composite of the toner core portion and the toner shell portion and then washing and drying the composite.

3. The toner of claim 1, wherein the resin having an active hydrogen containing group comprises a polyester resin including at least one selected from the group consisting of a hydroxyl group, a mercapto group, a carboxyl group, a phosphoric acid group, a sulfonate group and a sulfate group.

4. The method of claim 1, wherein the cross-linking agent comprises an isocyanate compound or an epoxy compound.

5. The method of claim 1, wherein the content of the cross-linking agent is in the range of 0.004 to 0.15 mol with respect to 1 mol of the active hydrogen containing group.

6. The method of claim 1, wherein the colorant is in the form of a pigment master batch.

7. The method of claim 1, wherein the additive comprises at least one of a charge control agent and a releasing agent.

8. The method of claim 1, wherein the dispersion medium comprises at least one of a polar solvent, a surfactant and a thickener.

* * * * *

UNITED STATES PATENT AND TRADEMARK OFFICE

CERTIFICATE OF CORRECTION

PATENT NO. : 8,475,995 B2
APPLICATION NO. : 12/739706
DATED : July 2, 2013
INVENTOR(S) : Hwang et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 341 days.

Signed and Sealed this
Eighth Day of September, 2015

Michelle K. Lee

Michelle K. Lee
*Director of the United States Patent and Trademark Office*